US011226072B2

(12) United States Patent
Zhuang et al.

(10) Patent No.: US 11,226,072 B2
(45) Date of Patent: Jan. 18, 2022

(54) LIGHTING APPARATUS HAVING ENHANCED WIRELESS SINGLE CAPABILITY

(71) Applicant: XIAMEN LEEDARSON LIGHTING CO., LTD, Fujian (CN)

(72) Inventors: Jiaqing Zhuang, Fujian (CN); Qiyuan Wang, Fujian (CN); Haipeng Xiao, Fujian (CN); Fengyu Yan, Fujian (CN); Hongkui Jiang, Fujian (CN); Xiaohong Chen, Fujian (CN); Jun Wang, Fujian (CN); Wei Liu, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 16/998,827

(22) Filed: Aug. 20, 2020

(65) Prior Publication Data

US 2021/0062979 A1 Mar. 4, 2021

(30) Foreign Application Priority Data

Aug. 26, 2019 (CN) ..... 201921390980.5

(51) Int. Cl.

| | |
|---|---|
| ***F21K 9/238*** | (2016.01) |
| ***F21V 29/70*** | (2015.01) |
| ***F21V 23/00*** | (2015.01) |
| ***F21V 23/06*** | (2006.01) |
| ***F21V 23/04*** | (2006.01) |
| *F21Y 115/10* | (2016.01) |

(52) U.S. Cl.

CPC ..... *F21K 9/238* (2016.08); *F21V 23/005* (2013.01); *F21V 23/045* (2013.01); *F21V 23/06* (2013.01); *F21V 29/70* (2015.01); *F21Y 2115/10* (2016.08)

(58) Field of Classification Search

CPC ..... F21K 9/238; F21K 9/232; F21V 29/70; F21V 23/005; F21V 23/045; F21V 23/06; F21V 23/0435; F21V 29/507; F21Y 2115/10; F21Y 2103/33

See application file for complete search history.

(56) References Cited

U.S. PATENT DOCUMENTS

| | | | | |
|---|---|---|---|---|
| 6,462,775 | B1 * | 10/2002 | Loyd | F21V 33/0052 348/143 |
| 10,801,675 | B2 * | 10/2020 | Cao | H05B 45/00 |
| 2015/0173148 | A1 * | 6/2015 | Casper | H05B 47/11 315/152 |

OTHER PUBLICATIONS

European seach report (Year: 2021).*
CN208253381, machine translation (Year: 2018).*
CN109519728, machine translaion (Year: 2019).*

* cited by examiner

*Primary Examiner* — Tracie Y Green
(74) *Attorney, Agent, or Firm* — Chun-Ming Shih; Lanway IPR Services

(57) ABSTRACT

A lighting apparatus includes a light source module, a light source plate, a wireless module, a fiberglass plate and external electrodes. The light source module includes a LED module. The light source plate is used for mounting the light source module. The wireless module includes an antenna and a radio frequency circuit for wirelessly communicating with an external device. The radio frequency circuit is electrically connected to the light source module. The fiberglass plate is used for mounting the wireless module. The antenna is disposed on an external surface of the fiberglass plate. The external electrodes for passing an external power source to the light source module.

18 Claims, 10 Drawing Sheets

LIGHTING APPARATUS HAVING ENHANCED WIRELESS SINGLE CAPABILITY

FIELD

The present invention is related to a lighting apparatus, and more particularly related to a lighting apparatus with multiple structures.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People want their light devices to have more functions for making their lives more convenient. In addition, communication technologies evolve rapidly. It is beneficial to combine the communication technology with the lighting technology to design better lighting devices for enhancing human life quality.

SUMMARY

In some embodiments, a lighting apparatus includes a light source module, a light source plate, a wireless module, a fiberglass plate and external electrodes.

The light source module includes a LED module. The light source plate is used for mounting the light source module. The wireless module includes an antenna and a radio frequency circuit for wirelessly communicating with an external device. The radio frequency circuit is electrically connected to the light source module. The fiberglass plate is used for mounting the wireless module. The antenna is disposed on an external surface of the fiberglass plate. The external electrodes are used for passing an external power source to the light source module.

In light source plate may include an aluminum substrate or other metal layer as heat dissipation unit for moving heat generated by the LED module to other places. The fiberglass plate, in other embodiments, may be replaced with a plastic plate or a non-metal plate mounted with the wireless module. By using the fiberglass plate or plastic plate as a substrate for mounting the wireless module enhances signal quality, which is particularly important in wireless transmission. The plastic plate or non-metal plate refers to a plate is made mainly with plastic material or non-metal material, but still may include certain metal wiring or metal components thereon.

In some embodiments, the lighting apparatus may also include a bulb shell and a bulb head. The external electrodes are disposed on the bulb head. An interior surface of the bulb shell faces to the LED module and the antenna is used for passing a light emitted by the LED module and a wireless signal to the antenna.

In some embodiments, the fiber glass plate and the light source plate are connected and integrated as a module block.

In some embodiments, the fiber glass plate is mounted with the wireless module. The light source plate is mounted with the light source module. Then, during assembling, the fiber glass plate with the wireless module is attached to the light source plate with the light source module.

The two components are connected as a module block before the module block is attached to the lighting apparatus like a light bulb. Specifically, the module block may be made in advance and then be assembled to make the final product as a unit.

In some embodiments, the module block has two conductive wires respectively electrically connected to the external electrodes on bulb head.

In some embodiments, the two conductive wires are two metal pins. When the lighting apparatus is a light bulb, the external electrodes are located on an Edison socket, which includes a lateral wall and a bottom terminal. The lateral wall and the bottom thermal are electricity isolated for receiving two ends of a power source.

The two pins are respectively connected to the bottom terminal and the lateral wall for routing electricity from the external power source to the wireless module and the light source module.

In some embodiments, the lighting apparatus may also include a heat sink part disposed between the bulb head and the bulb shell. The heat sink has an insulation layer and a conductive layer. An edge of the light source plate engages the conductive part of the heat sink part for passing heat generated by the LED module to the heat sink part.

In some embodiments, the insulation layer is made of plastic material enclosing the conductive layer.

In some embodiments, the heat sink part has a circular base for placing a peripheral edge of the light source plate.

In some embodiments, the bulb shell and the circular base clip and fix the light source plate.

In some embodiments, the conductive layer of the heat sink part transmits electricity from the external electrodes to the light source module.

In some embodiments, the light source plate has a central opening, and the fiber glass plate is disposed in the central opening.

In some embodiments, the lighting apparatus may also include a heat dissipation plate for mounting the fiber glass plate and the light source plate.

In some embodiments, the light source plate has an extension part protruding toward the central opening for mounting a driver circuit. The driver circuit converts an external power source to a driving current supplied to the LED module.

In some embodiments, there is a light guide structure changing a light path of a light emitting on the light guide structure.

In some embodiments, the light guide structure is a reflector cover covering the antenna and the radio frequency circuit.

In some embodiments, an auxiliary antenna is formed on a surface of the reflective cover.

In some embodiments, the fiber glass plate is stacked at a middle position above the light source plate.

In some embodiments, the fiber glass plate has a lens area covering the LED module diffusing light of the LED module.

In some embodiments, a plugging component is disposed below the fiber glass plate facing toward the external electrodes.

In some embodiments, there are some plugging components which has certain size, protruding from an attached surface with a significant height. Such plugging components like capacitor may help the lighting devices more stable or with further function. But, if such plugging components are mounted directly above the light source plate or the fiberglass plate, the plugging components may shield light of the LED module, causing certain shadow, which is undesired visual effect.

In some embodiments, the fiber glass plate is made with the wireless module as a wireless block module. Multiple wireless block modules mounted with different antennas and radio frequency circuits are selectable to be combined with the same light source plate. In other words, the inner components, e.g. the fiberglass plate may be corresponded to different outer components, e.g. the light source plate, for achieving various combinations to meet different needs while lowering overall design and stock cost. This is particularly important in mass production for products like lighting devices.

In some embodiments, the fiber glass plate and the light source plate are connected with a detachable plugging structure.

For examples, electrodes and associated plugging interfaces, like plugging pins and slots, USB connectors, or other structures are disposed on connection areas of the fiberglass plate and the light source plate. For different wireless modules and different light source modules, the same plugging interfaces are provided.

With such design, different parameters of lighting apparatuses are easily manufactured under a standard processing. This dramatically decreases stocking cost and speeding manufacturing speeds.

In addition, for some embodiments, the fiberglass plate may be replaced with another light source plate to add more light output while eliminating control functions. This is helpful for providing simple but high light output lighting devices.

DETAILED DESCRIPTION

Figure 1:
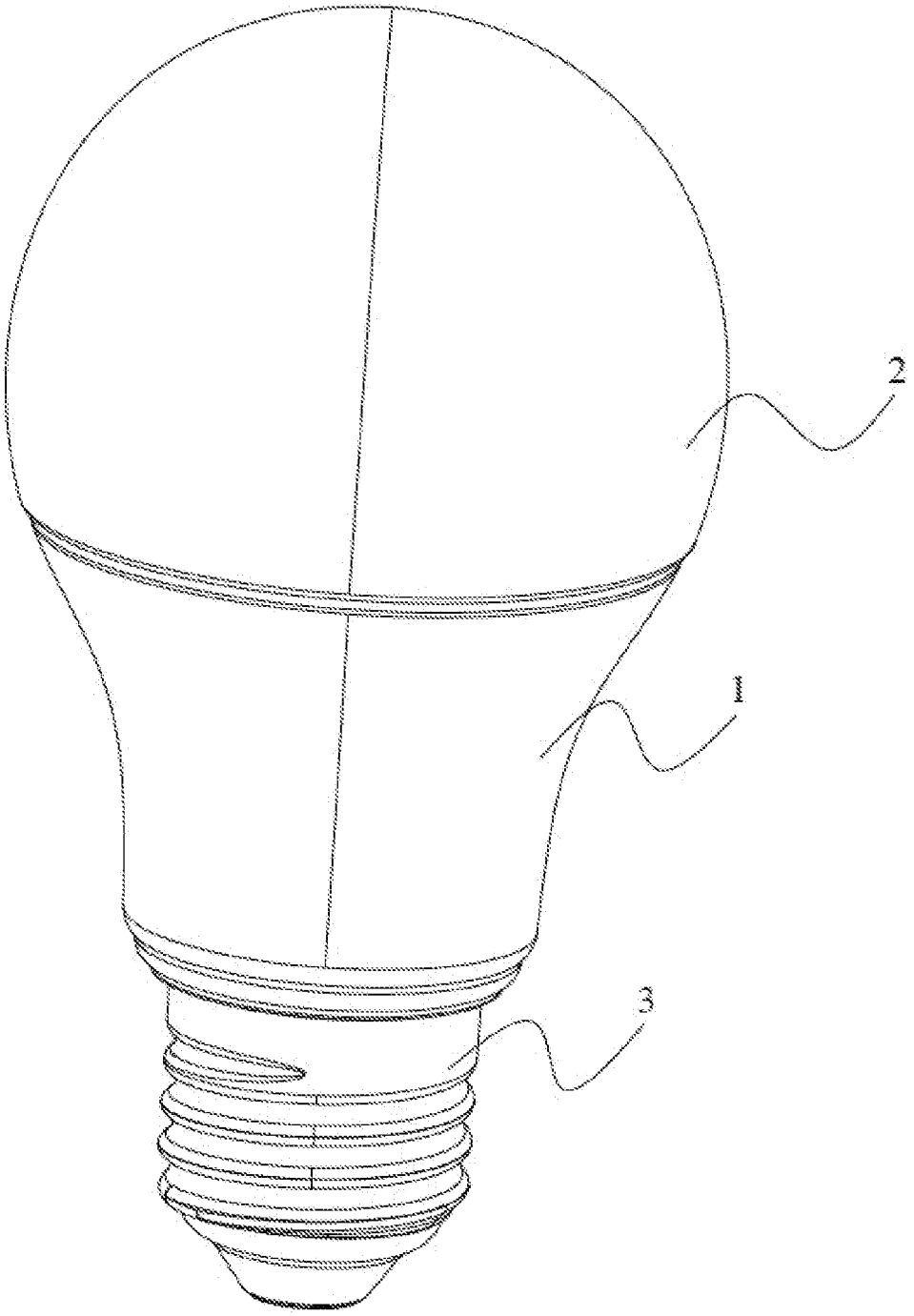
FIG. 1 illustrates a light bulb as a lighting apparatus embodiment.

Please refer to FIG. 1, which illustrates a lighting apparatus embodiment. The lighting apparatus embodiment is a light bulb having a bulb shell 2, a heat sink part 1 and a bulb head.

Figure 2:
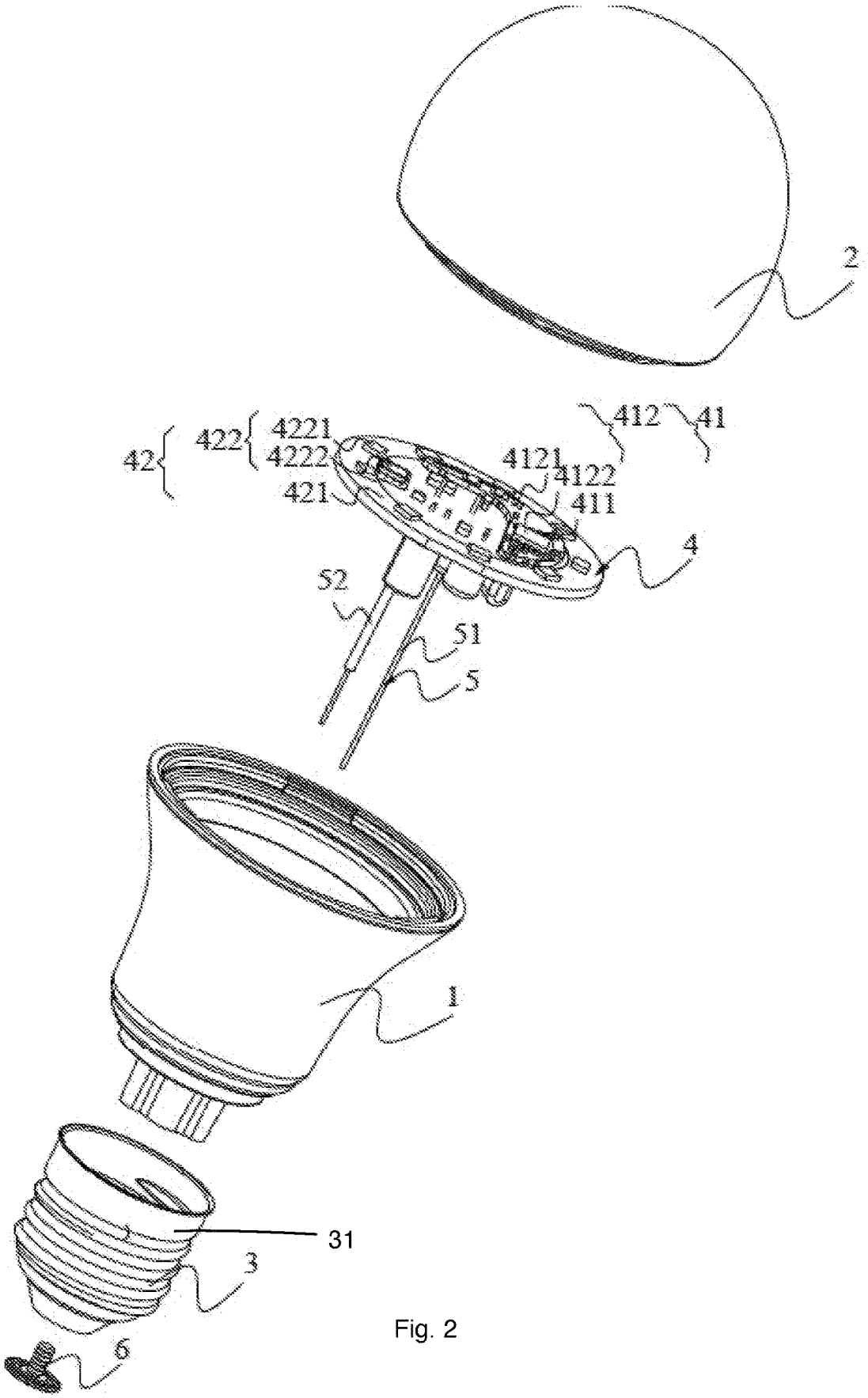
FIG. 2 illustrates an exploded view of the embodiment in FIG. 1.

FIG. 2 is an exploded view of the embodiment in FIG. 1. In FIG. 2, a lighting apparatus includes a light source module 422, a light source plate 421, a wireless module 41, a fiberglass plate 411 and external electrodes 3, 6.

The light source module 422 and the light source plate 421 form a second module 42. The wireless module 412 and the fiberglass plate 411 form a first module 41. The first module 41 and the second module 42 together form a module block, which may be assembled before installing to the light bulb.

The light source module 422 has a LED module 4221 and a driver circuit 4222. The driver circuit 4222 may be made as an integrated chip combined with some corresponding electronic components for converting an external power source to a driving current supplied to the LED module.

The wireless module 412 includes a radio frequency circuit 4122 and an antenna 4121.

The light source plate 421 is used for mounting the light source module 422. The antenna 4121 and the radio frequency circuit 4122 are used for wirelessly communicating with an external device 721. The radio frequency circuit 4122 is electrically connected to the light source module 422. The fiberglass plate 411 is used for mounting the wireless module 412. The antenna 4121 is disposed on an external surface 4127 of the fiberglass plate 411. The external electrodes 3, 6 are used for passing an external power source to the light source module. In this example, the external electrode 3 is a lateral wall of an Edison socket and the external electrode 6 is a bottom terminal of the Edison socket.

In some embodiments, the light source plate may include an aluminum substrate or other metal layer as heat dissipation unit for moving heat generated by the LED module to other places. The fiberglass plate, in other embodiments, may be replaced with a plastic plate mounted with the wireless module. By using the fiberglass plate or plastic plate as a substrate for mounting the wireless module enhances signal quality, which is particularly important in wireless transmission.

In some embodiments, the lighting apparatus may also include a bulb shell and a bulb head. The external electrodes are disposed on the bulb head. An interior surface of the bulb shell faces to the LED module and the antenna is used for passing a light emitted by the LED module and a wireless signal to the antenna.

In some embodiments, the fiber glass plate and the light source plate are connected and integrated as a module block.

In some embodiments, the fiber glass plate is mounted with the wireless module. The light source plate is mounted with the light source module. Then, during assembling, the fiber glass plate with the wireless module is attached to the light source plate with the light source module.

The two components are connected as a module block before the module block is attached to the lighting apparatus like a light bulb. Specifically, the module block may be made in advance and then be assembled to make the final product as a unit.

In FIG. 2, the module block has two conductive wires 51, 52 respectively electrically connected to the external electrodes 3, 6 on the bulb head 31.

In some embodiments, the two conductive wires 51, 52, as a conductive path 5, are two metal pins. When the lighting apparatus is a light bulb, the external electrodes are located on an Edison socket, which includes a lateral wall and a bottom terminal. The lateral wall and the bottom thermal are electricity isolated for receiving two ends of a power source.

The two pins are respectively connected to the bottom terminal and the lateral wall for routing electricity from the external power source to the wireless module and the light source module.

Figure 3:
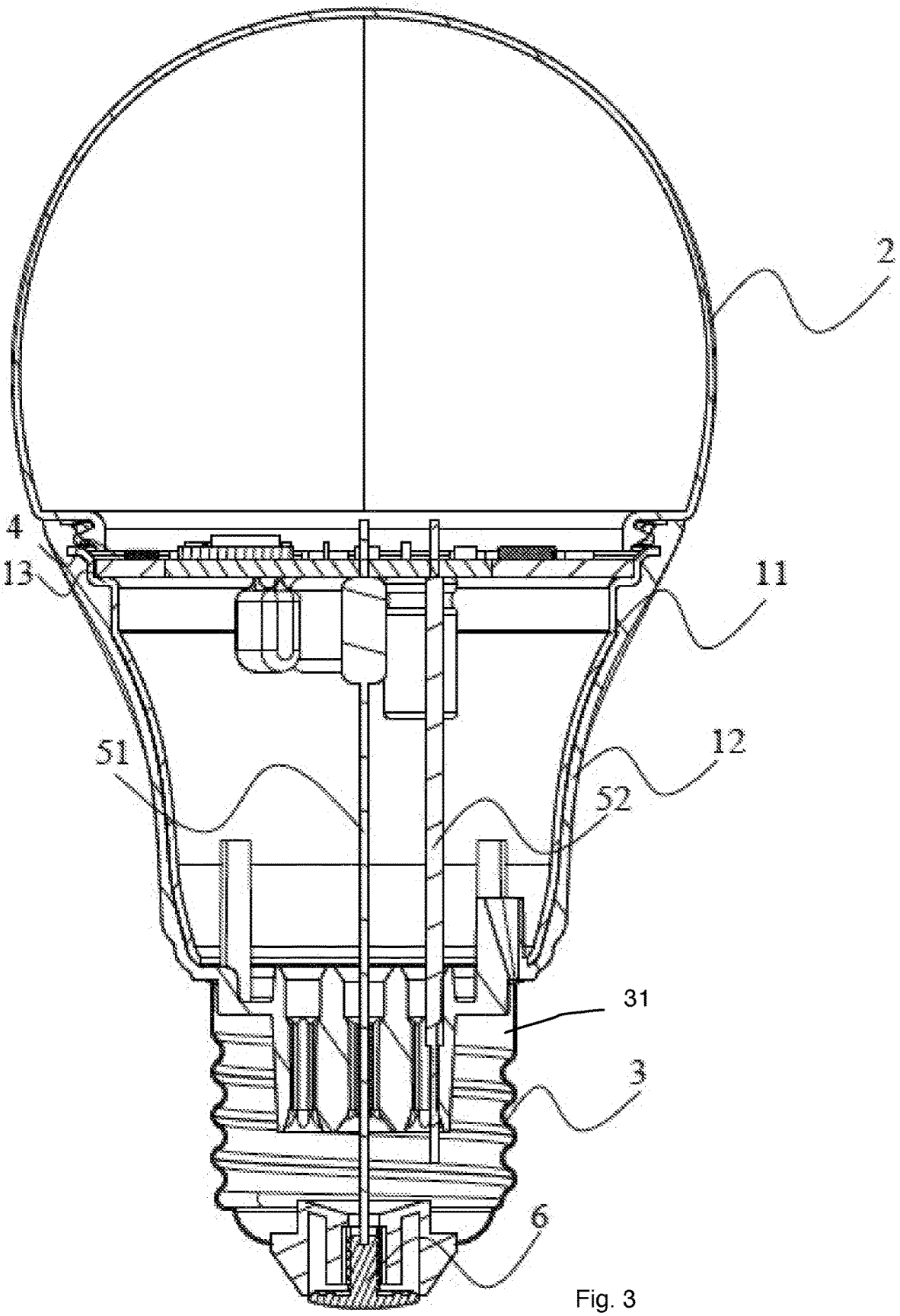
FIG. 3 illustrates a cross sectional view of the embodiment in FIG. 1.

Please refer to FIG. 3, which shows a cross sectional view of the example in FIG. 2. In FIG. 3, the lighting apparatus may also include a heat sink part disposed between the bulb head 31 and the bulb shell 2. The heat sink part has an insulation layer 11 and a conductive layer 12. An edge 1411 of the light source plate engages the conductive part 12 of the heat sink part for passing heat generated by the LED module to the heat sink part.

In some embodiments, the insulation layer is made of plastic material enclosing the conductive layer.

In FIG. 3, the heat sink part has a circular base 13 for placing a peripheral edge of the light source plate.

In some embodiments, the bulb shell and the circular base 13 clip and fix the light source plate.

In some embodiments, the conductive layer 11 of the heat sink part transmits electricity from the external electrodes to the light source module.

Figure 4:
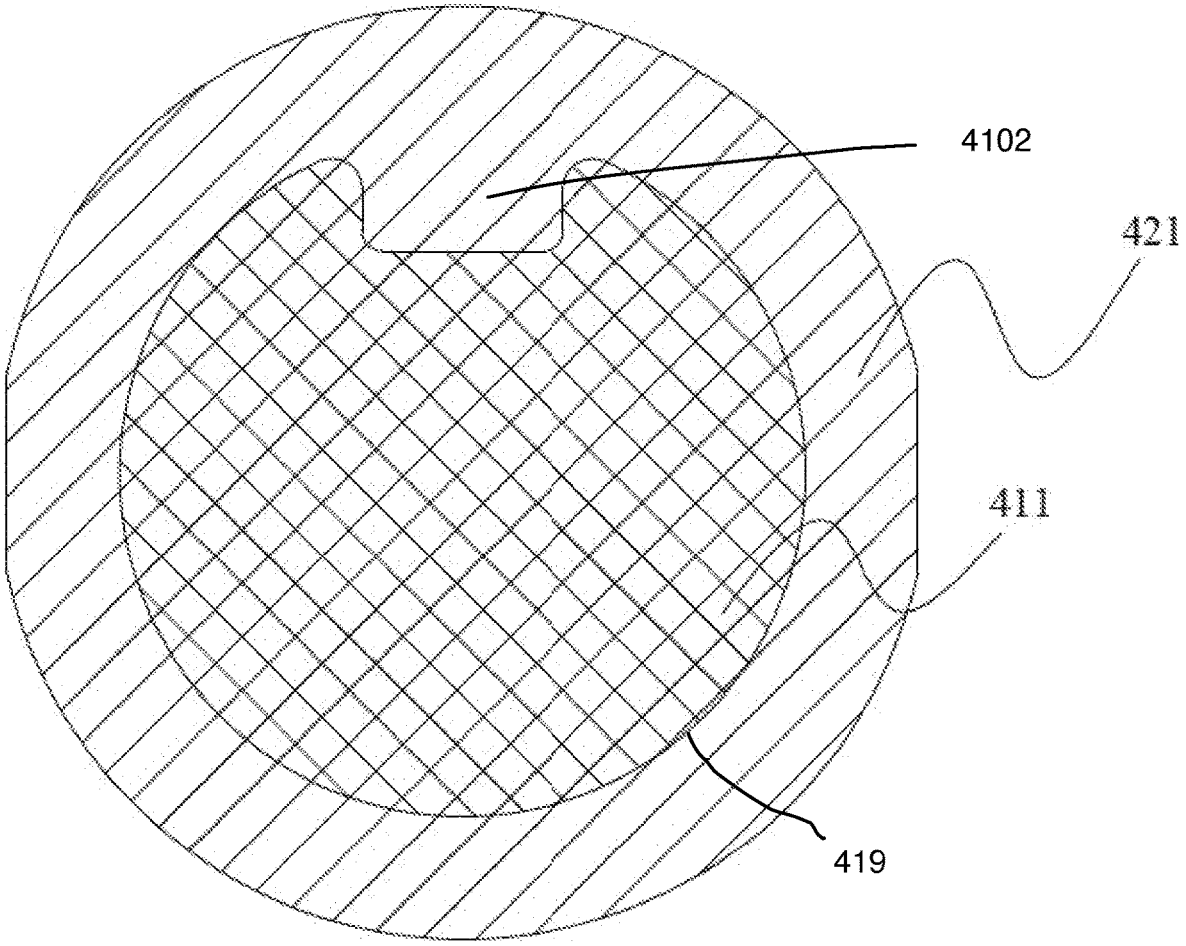
FIG. 4 illustrates a diagram showing an example of a component.

Please refer to FIG. 4, which shows a relation between the light source plate 421 and the fiberglass plate 411. The light source plate 421 has a central opening 419, and the fiber glass plate 411 is disposed in the central opening 419.

In FIG. 4, the lighting apparatus may also include a heat dissipation plate for mounting the fiber glass plate 421 and the light source plate 411.

In FIG. 4, the light source plate 421 has an extension part 4102 protruding toward the central opening for mounting a driver circuit 4222. The driver circuit 4222 converts an external power source to a driving current supplied to the LED module.

Figure 5:
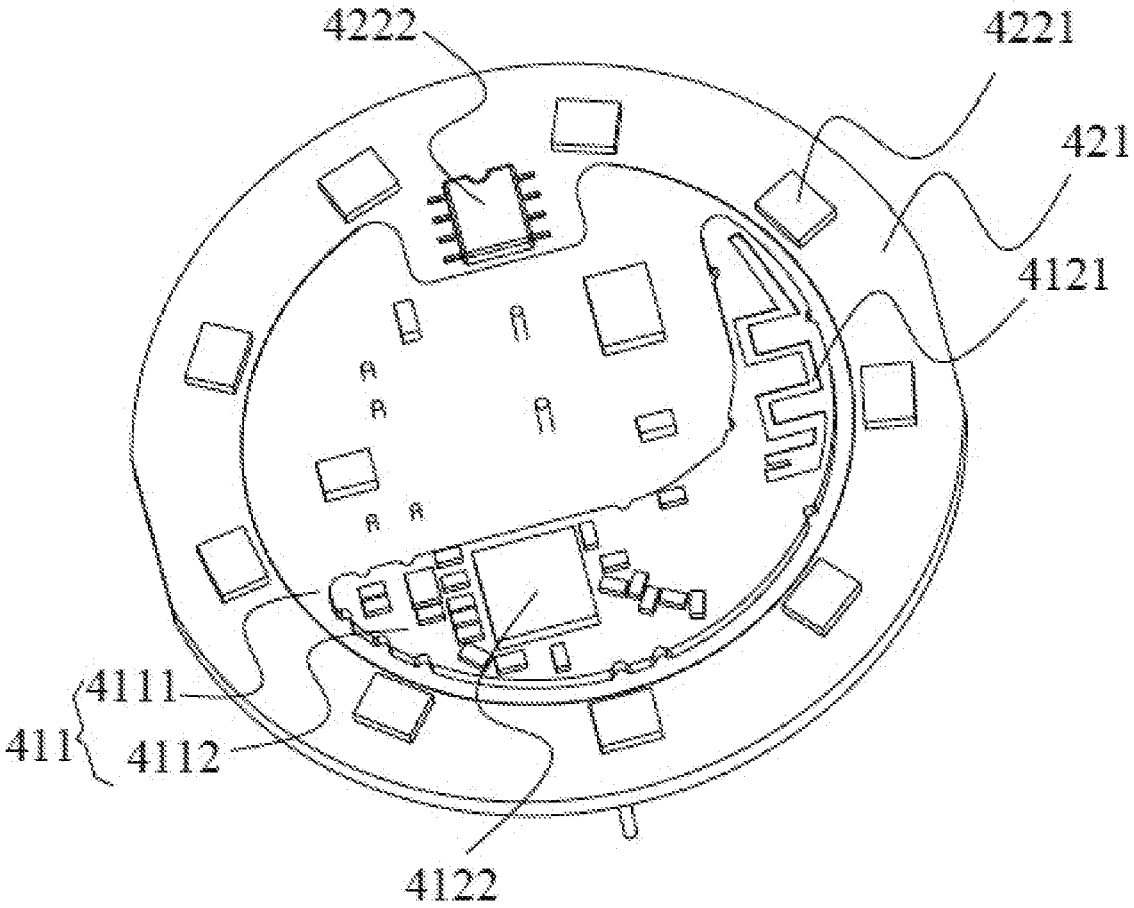
FIG. 5 illustrates a diagram showing a fiberglass plate and a light source plate.
Figure 6:
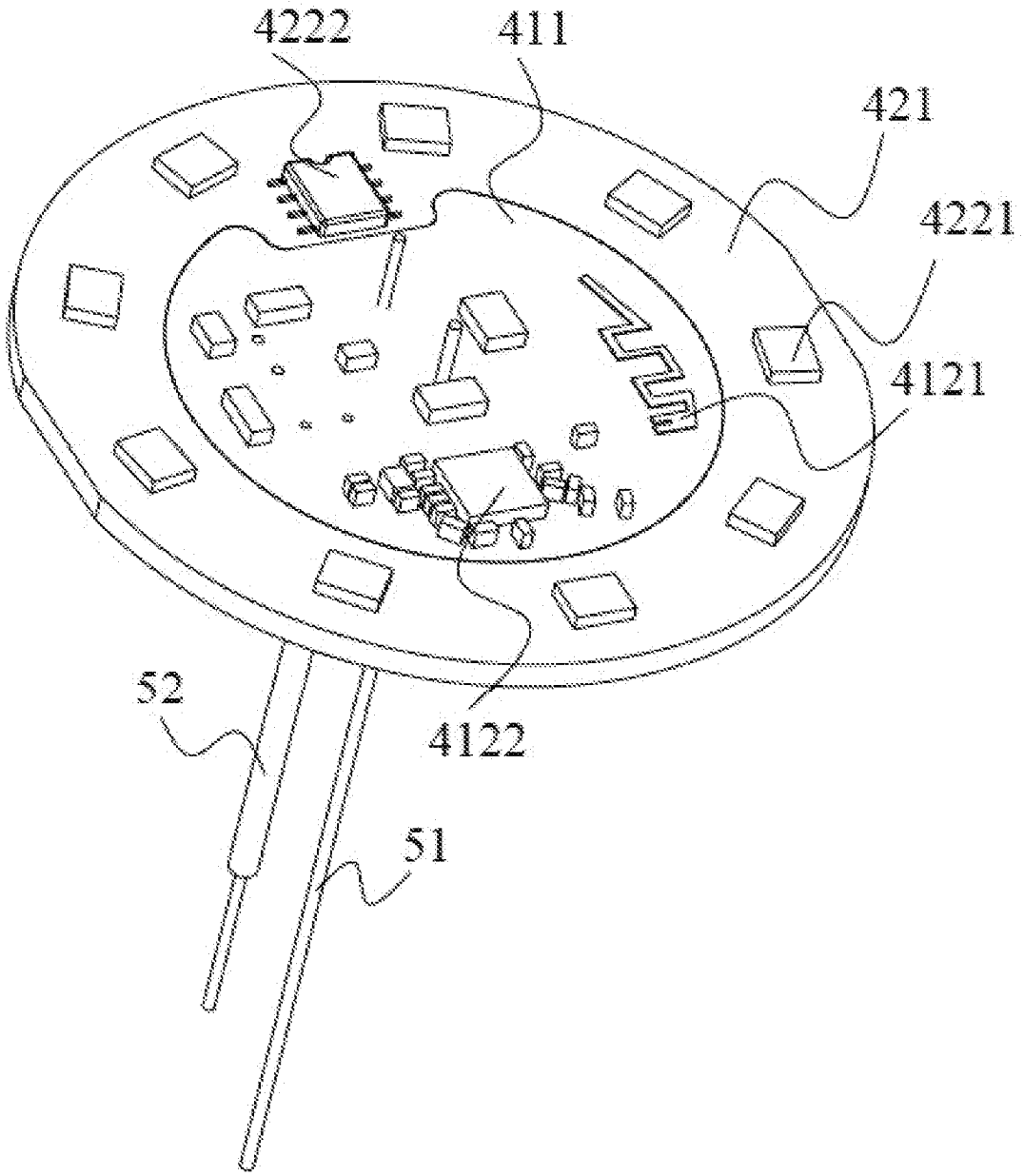
FIG. 6 illustrates another view of the example in FIG. 5.

FIG. 5 and FIG. 6 show different view of the component arrangement. The same reference numerals refer to the same components and are not repeated for brevity.

Figure 9:
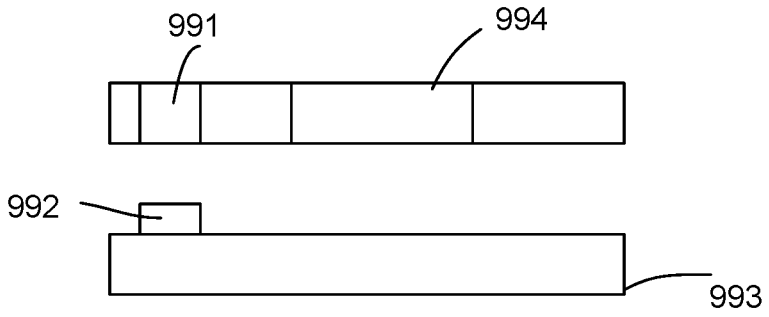
FIG. 9 shows a different embodiment of a fiberglass plate.

In FIG. 9, there is a light guide structure 991 changing a light path of a light emitting on the light guide structure.

Figure 10:
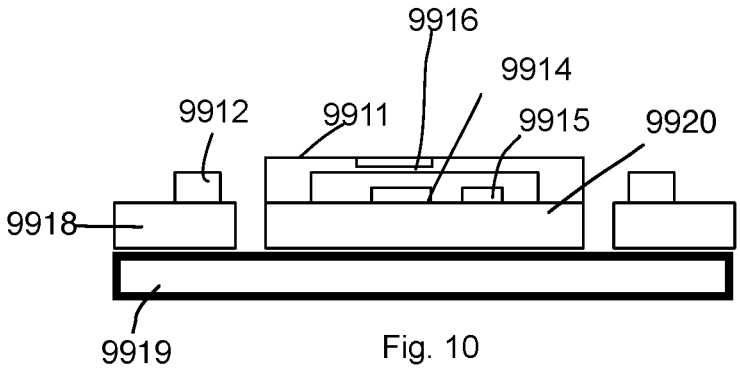
FIG. 10 shows another embodiment of a fiberglass plate.

In FIG. 10, the light guide structure is a reflector cover 9911 covering the antenna 9914 and the radio frequency circuit 9915.

The light source 9912 is mounted on a light source plate 9918. The light source plate 9918 has a ring shape with a central opening surrounding the fiberglass plate 9920 which is used for mounting the antenna 9914 and the radio frequency circuit 9915.

In this embodiment, a heat dissipation plate 9919 is placed below both the light source plate 9918 and the fiberglass plate 9920 for fixing and mounting the light source plate 9918 and the fiberglass plate 9920. The heat dissipation plate is used for carrying heat away from both the radio frequency circuit 9915 and the light source 9912.

In some embodiment, the heat dissipation plate 9919 engages the heat sink part to further pass the heat away from electronic components to enhance life span of the lighting apparatus.

In some embodiments, an auxiliary antenna 9916 is formed on a surface of the reflective cover 9911.

In some embodiments, the fiber glass plate is stacked at a middle position above the light source plate.

In FIG. 9, the fiber glass plate 994 has a lens area 991 covering the LED module 992 diffusing light of the LED module 992 on the light source plate 993.

In FIG. 3, a plugging component 987 is disposed below the fiber glass plate facing toward the external electrodes.

In some embodiments, there are some plugging components which has certain size, protruding from an attached surface with a significant height. Such plugging components like capacitor may help the lighting devices more stable or with further function. But, if such plugging components are mounted directly above the light source plate or the fiberglass plate, the plugging components may shield light of the LED module, causing certain shadow, which is undesired visual effect.

In some embodiments, the fiber glass plate is made with the wireless module as a wireless block module. Multiple wireless block modules mounted with different antennas and radio frequency circuits are selectable to be combined with the same light source plate.

In other words, the inner components, e.g. the fiberglass plate may be corresponded to different outer components, e.g. the light source plate, for achieving various combinations to meet different needs while lowering overall design and stock cost. This is particularly important in mass production for products like lighting devices.

In some embodiments, the fiber glass plate and the light source plate are connected with a detachable plugging structure.

For examples, electrodes and associated plugging interfaces, like plugging pins and slots, USB connectors, or other structures are disposed on connection areas of the fiberglass plate and the light source plate. For different wireless modules and different light source modules, the same plugging interfaces are provided.

With such design, different parameters of lighting apparatuses are easily manufactured under a standard processing. This dramatically decreases stocking cost and speeding manufacturing speeds.

In addition, for some embodiments, the fiberglass plate may be replaced with another light source plate to add more light output while eliminating control functions. This is helpful for providing simple but high light output lighting devices.

In some embodiments, the fiberglass plate and the light source plate are made as a composite plate. For example, the central opening is made as a concave area for filling the material of fiberglass to form the fiber glass plate.

The bulb shell may be mad of PVC (Polyvinyl chloride) or PET (Polyethylene terephthalate) for reducing noise to the wireless signal of the wireless module, which may provide better signal quality compared with other material.

The heat sink part may be made of an aluminum tube molded with plastic material.

In the embodiments of FIG. 4 to FIG. 6, the light source plate and the fiberglass plate are located substantially at the same plane. In such design, the antenna is not affected by the light source. The light source is not affected by the wireless module, either.

The electrical connection between the light source module and the wireless module may be achieved by conductive path formed on a common plate for holding the fiberglass plate and the light source plate.

The antenna may be a single pole antenna, with a strip shape, a ladder shape, a screw shape, a ladder shape or a ring shape.

Figure 7:
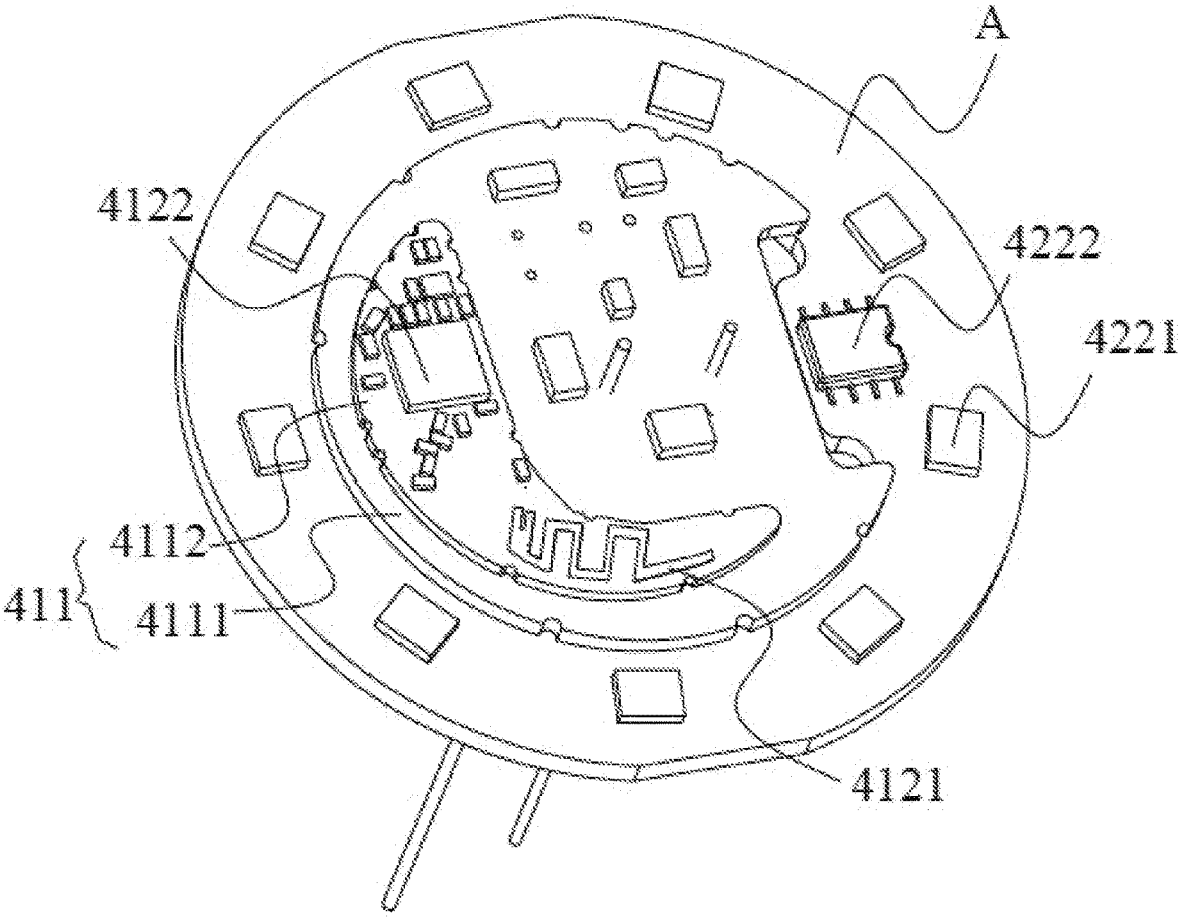
FIG. 7 illustrates another embodiment of a fiberglass plate integrated with a light source plate.
Figure 8:
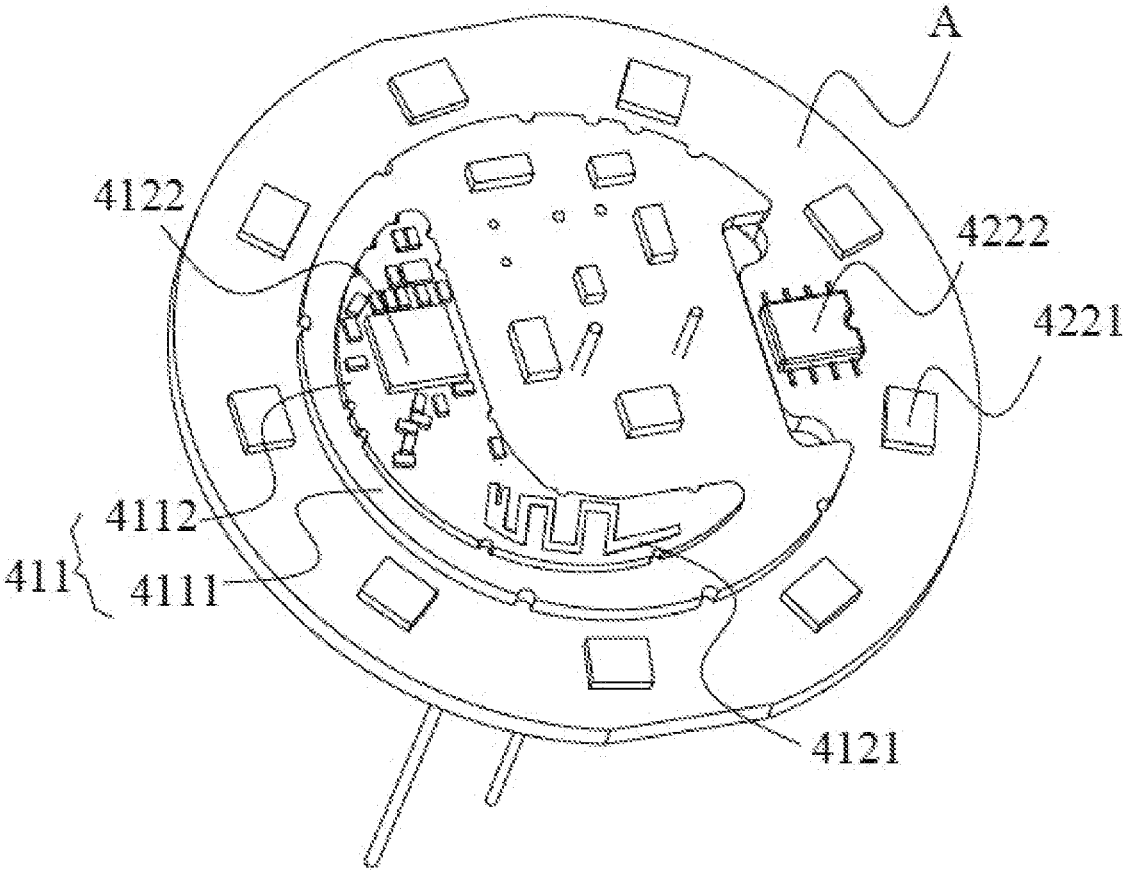
FIG. 8 illustrates an embodiment of a fiberglass plate integrated with a light source plate.

FIG. 7 and FIG. 8 show a different way for placing the light source plate and the fiberglass plate. In FIG. 7 and FIG. 8, the fiberglass plate is stacked at a middle position of the light source plate. The same reference numerals refer to the same components and are not repeated here for brevity.

In some embodiments, the antenna is electrically connected to the light source and then further electrically connected to the conductive layer of the heat sink part. This increase the signal quality.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a light source module comprising a LED module;

a light source plate for mounting the light source module;

a wireless module comprising an antenna and a radio frequency circuit for wirelessly communicating with an external device, wherein the radio frequency circuit is electrically connected to the light source module;

a fiberglass plate for mounting the wireless module, wherein the antenna is disposed on an external surface of the fiberglass plate;

external electrodes for passing an external power source to the light source module; and a heat sink part disposed between the bulb head and the bulb shell, wherein the heat sink part has an insulation layer and a conductive layer, an edge of the light source plate engages the conductive part of the heat sink part for passing heat generated by the LED module to the heat sink part, wherein the antenna is electrically connected to the light source and then further electrically connected to the conductive layer of the heat sink part.

2. The lighting apparatus of claim 1, further comprising a bulb shell and a bulb head, the external electrodes being disposed on the bulb head, an interior surface of the bulb shell facing to the LED module and the antenna for passing a light emitted by the LED module and a wireless signal to the antenna.

3. The lighting apparatus of claim 2, wherein the fiber glass plate and the light source plate are connected and integrated as a module block.

4. The lighting apparatus of claim 3, wherein the module block has two conductive wires respectively electrically connected to the external electrodes on bulb head.

5. The lighting apparatus of claim 1, wherein the insulation layer is made of plastic material enclosing the conductive layer.

6. The lighting apparatus of claim 1, wherein the heat sink part has a circular base for placing a peripheral edge of the light source plate.

7. The lighting apparatus of claim 6, wherein the bulb shell and the circular base clip and fix the light source plate.

8. The lighting apparatus of claim 1, wherein the light source plate has a central opening, and the fiber glass plate is disposed in the central opening.

9. The lighting apparatus of claim 8, further comprising a heat dissipation plate for mounting the fiber glass plate and the light source plate.

10. The lighting apparatus of claim 8, wherein the light source plate has an extension part protruding toward the central opening for mounting a driver circuit, the driver circuit converting an external power source to a driving current supplied to the LED module.

11. The lighting apparatus of claim 8, wherein there is a light guide structure changing a light path of a light emitting on the light guide structure.

12. The lighting apparatus of claim 11, wherein the light guide structure is a reflector cover covering the antenna and the radio frequency circuit.

13. The lighting apparatus of claim 12, wherein an auxiliary antenna is formed on a surface of the reflective cover.

14. The lighting apparatus of claim 1, wherein the fiber glass plate is stacked at a middle position above the light source plate.

15. The lighting apparatus of claim 14, wherein the fiber glass plate has a lens area covering the LED module diffusing light of the LED module.

16. The lighting apparatus of claim 1, wherein a plugging component is disposed below the fiber glass plate facing toward the external electrodes.

17. The lighting apparatus of claim 1, wherein the fiber glass plate is made with the wireless module as a wireless block module, multiple wireless block modules mounted with different antennas and radio frequency circuits are selectable to be combined with the same light source plate.

18. The lighting apparatus of claim 17, wherein the fiber glass plate and the light source plate are connected with a detachable plugging structure.

* * * * *